US006234330B1

(12) United States Patent
Gray

(10) Patent No.: US 6,234,330 B1
(45) Date of Patent: May 22, 2001

(54) V-SHAPED UPRIGHT PRODUCT MERCHANDISER

(75) Inventor: Robert Gray, Brookpark, OH (US)

(73) Assignee: Fasteners For Retail, Inc., Cleveland, OH (US)

( * ) Notice: Subject to any disclaimer, the term of this patent is extended or adjusted under 35 U.S.C. 154(b) by 0 days.

(21) Appl. No.: 09/516,799

(22) Filed: Mar. 1, 2000

(51) Int. Cl.[7] ..... A47F 5/00
(52) U.S. Cl. ..... 211/106; 211/59.1; 211/103
(58) Field of Search ..... 211/106, 87.01, 211/59.1, 57.1, 103, 181.1; D6/465

(56) References Cited

U.S. PATENT DOCUMENTS

| | | | | |
|---|---|---|---|---|
| D. 352,848 | * | 11/1994 | Dardashti | D6/465 |
| D. 394,980 | * | 6/1998 | Goodman . | |
| 1,093,856 | | 4/1914 | Hurff . | |
| 3,398,867 | | 8/1968 | Taylor et al. . | |
| 3,659,722 | * | 5/1972 | Canoll | 211/106 |
| 4,697,712 | * | 10/1987 | Valiolis . | |
| 4,832,298 | * | 5/1989 | Metcalf | 211/59.1 X |
| 4,884,702 | * | 12/1989 | Rekow | 211/106 X |
| 4,913,297 | * | 4/1990 | Wells | 211/106 X |
| 5,038,943 | * | 8/1991 | Reinke | 211/59.1 |
| 5,284,259 | | 2/1994 | Conway et al. . | |
| 5,346,166 | | 9/1994 | Valiulis . | |
| 5,398,824 | * | 3/1995 | Wolff et al. | 211/106 X |
| 5,588,543 | * | 12/1996 | Finger | 211/106 X |
| 5,683,003 | | 11/1997 | Gebka . | |
| 5,887,731 | * | 3/1999 | Thaleufeld | 211/57.1 |
| 6,006,929 | * | 12/1999 | Leonard | 211/106 X |
| 6,070,747 | * | 6/2000 | Shea | 211/87.01 |

OTHER PUBLICATIONS

Southern Imperial, Inc. Advertisement, P–O–P Times, Jul./Aug. 1994, p. 24.
FFR 1999 Yellow Pages Catalogue, Cover Page and pp. 86–90.

* cited by examiner

*Primary Examiner*—Robert W. Gibson, Jr.
(74) *Attorney, Agent, or Firm*—Fay, Sharpe, Fagan, Minnich & McKee, LLP

(57) ABSTRACT

An upright product merchandiser that increases the space available for displaying products such as cross-merchandised products without interfering with shelved products, is disclosed. The product merchandiser includes a first elongate rung and a second elongate rung which is spaced apart from the first elongate rung. The first and second elongate rungs extend generally parallel to a longitudinal axis of the product merchandiser. A plurality of V-shaped rungs are spaced apart from each other and extend generally normal to the longitudinal axis of the product merchandiser. Each V-shaped rung includes a first leg and a second leg that diverge from an apex. The first leg of each V-shaped rung is joined to a first elongate rung, and the second leg of each V-shaped rung is joined to a second elongate rung. The first legs of the V-shaped rungs cooperate with the first elongate rung to define a first side of the product merchandiser, and the second legs of the V-shaped rungs cooperate with the second elongate rung to define a second side of the product merchandiser. The first and second legs of the V-shaped rungs are each adapted to removably support an associated hanger for holding merchandise. At least one support clip engages the first and second elongate rungs, and engages with a mounting clip of an associated shelving unit to removably secure the product merchandiser to the shelving unit.

20 Claims, 8 Drawing Sheets

V-SHAPED UPRIGHT PRODUCT MERCHANDISER

FIELD OF THE INVENTION

The present invention relates generally to point-of-purchase product holders that display merchandise. More particularly, it relates to a configurable, V-shaped, upright product merchandiser that increases the space available for displaying merchandise without interfering with other shelved products.

BACKGROUND OF THE INVENTION

Businesses use a wide variety of devices to display and market products to consumers. One ubiquitous way of displaying products in a retail environment involves the use of a plurality of vertically spaced, horizontally extending display shelves. A common marketing strategy, generally referred to as cross-merchandising, is to display synergistically related items together (e.g. cake mixes and birthday cake candles; flashlights and batteries; tooth paste and tooth brushes, and the like). For obvious reasons, it is not an efficient utilization of scarce, and thus valuable, shelf space, nor an effective marketing strategy, to place, for instance, birthday candles at the end of fifteen to twenty feet of cake mixes.

U.S. Pat. Nos. 5,346,166 and 5,683,003 generally disclose strip merchandiser hanger assemblies that display merchandise in front of a horizontal shelving unit. For example, the disclosed strip merchandiser hanger assemblies can be used to display birthday cake candles directly in front of cake mixes, rather than adjacent to the cake mixes. The disclosed hanger assemblies are adapted to support generally opposite facing plastic strip merchandisers at any location along the horizontal shelving unit. The plastic strip merchandisers each include uniformly spaced tabs, or triple-finger locking mechanisms that releasably grip the displayed merchandise.

One clear problem with these known strip merchandiser hangers is that the associated plastic strip merchandisers cannot be conveniently and cost-effectively configured or reconfigured, if at all, to support different types of merchandise. That is, no single strip merchandiser can support different products such as large products, small products, heavy products, and/or light-weight products, etc. (e.g. blister packs of different sized batteries) at the same time.

Accordingly, it is considered desirable to provide a new and improved upright product merchandiser that overcomes the foregoing difficulties and others while providing better and more advantageous results.

SUMMARY OF THE INVENTION

The principal object of the present invention is to provide an upright product merchandiser that increases the space available for displaying products such as cross-merchandised products without interfering with shelved products.

In accordance with one aspect of the present invention, a product merchandiser frame includes a first elongate rung, and a second elongate rung spaced from the first elongate rung. The first and second elongate rungs extend generally parallel with a longitudinal axis of the product merchandiser. A plurality of V-shaped rungs are spaced apart from each other and extend generally normal to the longitudinal axis of the product merchandiser. Each V-shaped rung include a first leg and a second leg that diverge from an apex. The first leg of each V-shaped rung is joined to the first elongate rung, and the second leg of each V-shaped rung is joined to the second elongate rung The first legs of the V-shaped rungs cooperate with the first elongate rung to define a first side of the product merchandiser, and the second legs of the V-shaped rungs cooperate with the second elongate rung to define a second side of the product merchandiser. The first and second legs of the V-shaped rungs are each adapted to removably support an associated hanger for holding merchandise.

In accordance with a second aspect of the present invention, a product merchandiser includes a frame with a first rung, and a second rung spaced from the first rung. The first and second rungs extend generally parallel with a longitudinal axis of the product merchandiser. A plurality of third rungs are spaced apart from each other, and each extend generally normal to the longitudinal axis of the product merchandiser. Each third rung has a first leg and a second leg, the first leg being joined to the first rung and the second leg being joined to the second rung. At least one support clip is adapted to selectively engage the first and second rungs, and engage with an associated mounting clip of an associated shelving unit.

In accordance with a third aspect of the present invention, a product merchandising system that is secured to a shelving unit for displaying products is disclosed. The product merchandising system includes a frame including a first rung, and a second rung spaced from the first rung. The first and second rungs extend generally parallel with a longitudinal axis of the frame. A plurality of third rungs are spaced apart from each other with each extending generally normal to the longitudinal axis of the frame. Each third rung has a first leg and a second leg. The first leg is joined to the first rung and the second leg is joined to the second rung. At least one support clip selectively engages with the first and second rungs. At least one mounting clip secures the frame to the support surface. The at least one support clip is selectively supported by the at least one mounting clip.

One advantage of the present invention is the provision of a new and improved upright product merchandiser that is configurable and reconfigurable.

Another advantage of the present invention is the provision of an upright product merchandiser that is sturdy and can accommodate a large amount of the same type or different types of merchandise, even heavy merchandise, in a small amount of space.

Still another advantage of the present invention is the provision of an upright product merchandiser that incorporates a plurality of movable hooks for configuring and reconfiguring the merchandiser.

Yet another advantage of the present invention is the provision of an upright product merchandiser that can be positioned and repositioned horizontally and vertically relative to a shelving system.

A further advantage of the present invention is the provision of an upright product merchandiser that can easily accommodate products of varying sizes.

Yet a further advantage of the present invention is the provision of an upright product merchandiser that can be easily assembled and disassembled without the need for tools.

Still further advantages of the present invention will become apparent to those of ordinary skill in the art upon reading and understanding the following detailed description of the preferred embodiment.

BRIEF DESCRIPTION OF THE DRAWINGS

The invention may take form in various components and arrangements of components, and in various steps and arrangements of steps. The drawings are only for purposes of illustrating a preferred embodiment(s) and are not to be construed as limiting the invention.

DETAILED DESCRIPTION OF THE PREFERRED EMBODIMENTS

Figure 1:
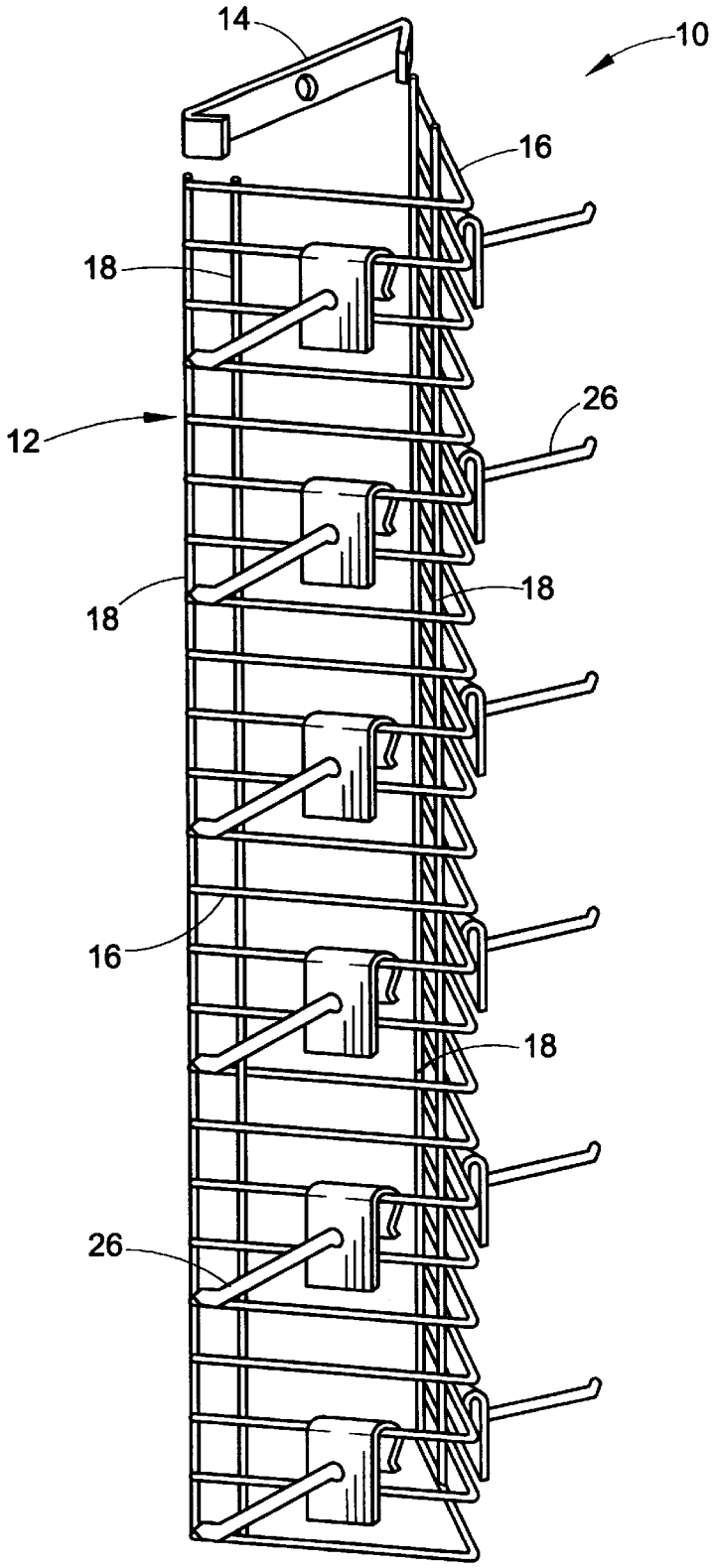
FIG. 1 is an exploded perspective view of an upright product merchandiser that incorporates the features of the present invention therein.

With reference to FIG. 1, a configurable and reconfigurable, upright, product merchandiser 10 includes a rack or frame 12 and at least one, and preferably two or more support clips 14 that removably secure the frame 12 to a shelving unit. The frame 12 includes a plurality of generally V-shaped rungs 16 and elongate rungs 18. Certain terminology is used herein to describe the product merchandiser 10 for convenience in reference only, and is not to be construed as limiting. For example, the V-shaped rungs 16 are generally "horizontally" oriented, and are spaced apart in a "vertically" stacked configuration, while the elongate rungs 18 extend generally "vertically" or perpendicular to the V-shaped rungs 16 along a longitudinal axis of the frame 12.

Figure 3:
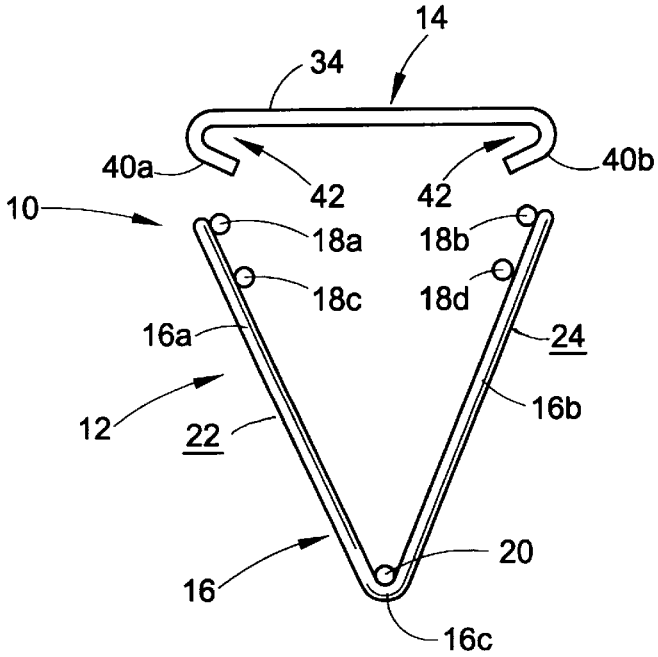
FIG. 3 is an exploded top view of the upright product merchandiser of FIG. 1.

In the embodiment being described the rungs 16, 18 are each formed from a metal wire or rod such as an ⅛", 3/16", ¼", etc. diameter metal wire or rod. Referring to FIG. 3, each rung 16 is formed by bending a wire rod to form two legs 16*a*, 16*b* that diverge from an apex or point 16*c*. It is contemplated that the leg 16*a* can be oriented at any angle from the leg 16*b*, such as within the range of about 10° to about 90°, and preferably within the range of about 40° to about 60 °.

With continued reference to FIG. 3, the free ends of each leg 16*a*, 16*b* are secured, such as by spot welding, to respective elongate rungs 18*a*, 18*b*. Additionally, the legs 16*a*, 16*b* can be welded, at intermediate portions thereof, to additional elongate rungs 18*c*, 18*d* in order to increase the structural integrity of the product merchandiser frame 12. Alternatively, or in addition to the elongate rungs 18*c*, 18*d*, it is contemplated that increased structural integrity can be obtained by welding an elongate rung 20 to the inner apex or tip 16*c* of each V-shaped rung 16.

Still referring to FIG. 3, the legs 16*a* of the V-shaped rungs 16, and the elongate rungs 18*a*, 18*c* cooperate to define a first side 22 of the frame 12, and the other legs 16*b* of the V-shaped rungs 16, and the elongate rungs 18*b*, 18*d* cooperate to define a second side 24 of the frame 12. Referring back to FIG. 1, a plurality of conventional metal or plastic hangers 26 are adapted to removably clip over the individual legs 16*a*, 16*b* that form the respective sides 22, 24 of the frame 12.

Figure 2:
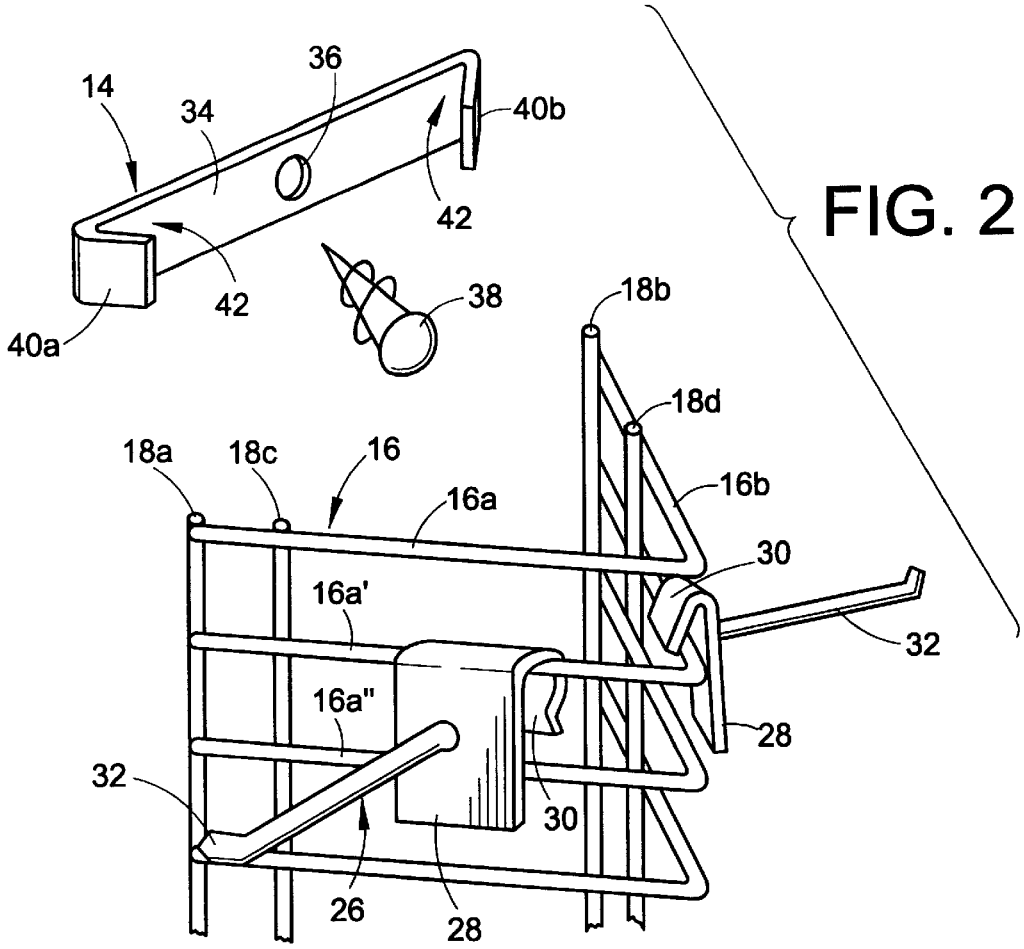
FIG. 2 is an exploded perspective view of an upper portion of the upright product merchandiser of FIG. 1.

With reference now to FIG. 2, the hangers 26 each include a base 28, a hook portion 30 extending from an upper end of the base 28, and a hanger arm 32 extending from a front surface of the base 28. With the hook portion 30 engaging a first leg 16*a*' of the frame 12, a rear surface of the base 28 contacts a second leg 16*a*" immediately below the first leg 16*a*' so that the hanger arm 32 remains generally horizontal. Thus, when mounted to the frame 12, the hanger arms 32 are adapted to support a wide variety of merchandise. It is contemplated that the free ends of the hanger arms can be turned or bent upward to prevent merchandise from inadvertently falling from the frame.

Referring again to FIG. 1, the hangers 26 can be positioned and repositioned to most effectively display a wide variety of cross-merchandised products. For instance, it is contemplated that one type of merchandise, such as birthday cake candles, can be displayed on hangers 26 that are clipped to the legs 16*a* associated with the first side 22 of the frame 12, while photographic film (cross-merchandised with candles and cake mix) can be displayed on hangers 26 that are clipped to the legs 16*b* associated with the second side 24 of the frame 12. Since a multi-roll package of photographic film typically requires more space than a blister pack or box of birthday candles, the position of the hangers on each side 22, 24 of the frame 12 can be adjusted to properly accommodate, and thus maximize the display and arrangement of the different types of merchandise.

With reference again to FIG. 2, the support clip 14 includes an intermediate portion 34 having a central aperture 36 adapted to receive a conventional fastener 38 for securing the support clip and depending frame 12 to a shelving unit as described further below. The fastener 38 can be a so-called "Christmas tree" clip made of plastic material, or any other known type of fastener. Each end 40*a*, 40*b* of the intermediate support clip portion 34 is bent so as to extend at an acute angle relative to the intermediate portion 34. The bent free end portions 40*a*, 40*b* cooperate with the intermediate portion 34 to define pockets 42.

Figure 4:
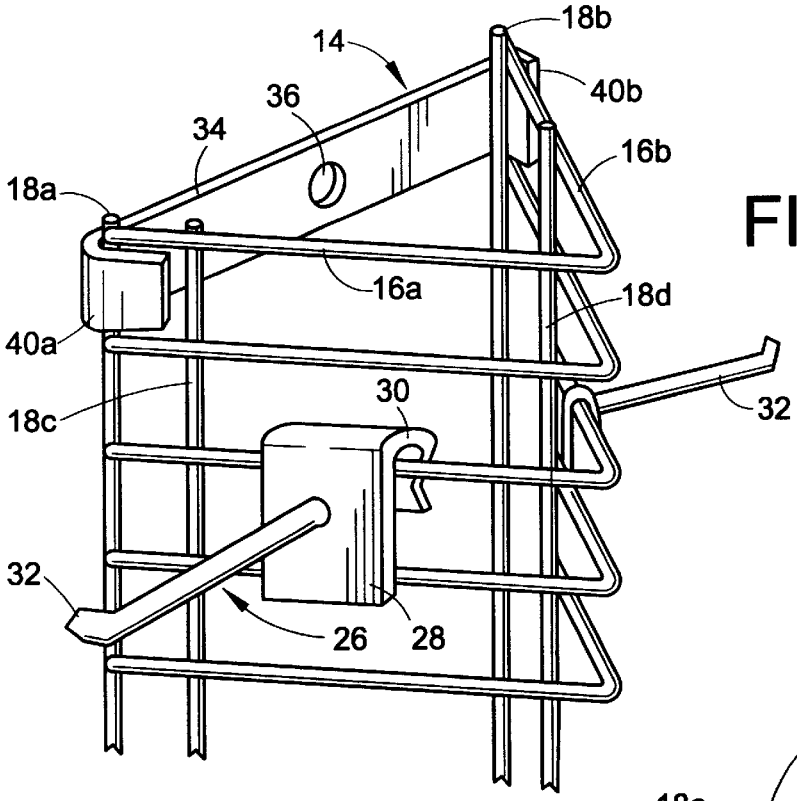
FIG. 4 is an assembled perspective view of an upper portion of the upright product merchandiser of FIG. 1.
Figure 5:
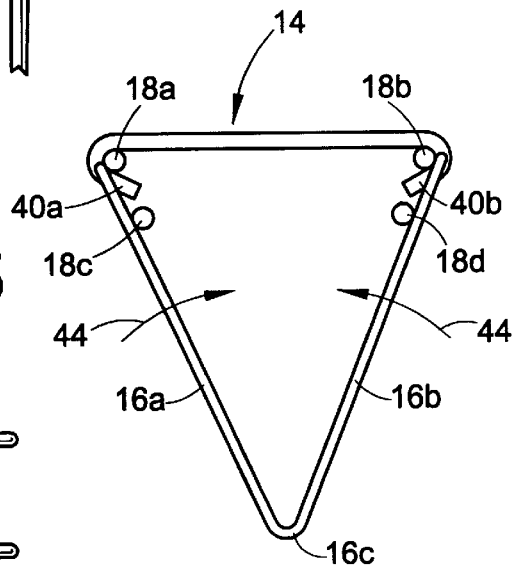
FIG. 5 is a top plan view of the upright product merchandiser of FIG. 4.
Figure 6:
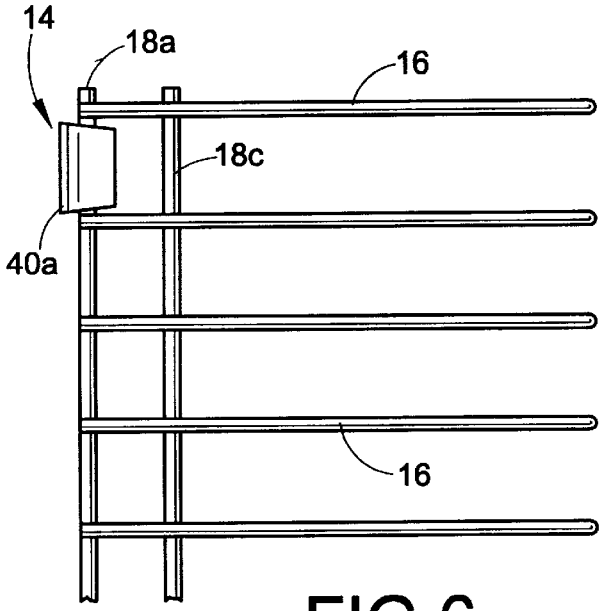
FIG. 6 is a side elevation view of the upper portion of the upright product merchandiser of FIG. 4.

With reference now to FIG. 5, the frame 12 is mounted to each support clip 14 by slightly squeezing the free ends of the V-shaped rung legs 16*a*, 16*b* toward each other (i.e. in the direction of arrows 44) against a spring force that is generated when the rung legs 16*a*, 16*b* are repositioned. The vertical rungs 18*a*, 18*b* are then placed within the pockets 42, and the squeezing force on the rung legs 16*a*, 16*b* is reduced to permit the vertical rungs 18*a*, 18*b* to expand into abutment with the clip 14. The rung legs 16*a*, 16*b* remain urged against the clip 14 by the spring force that was generated when squeezing the rung legs 16*a*, 16*b* toward each other. It is contemplated that any number of support clips 14 can be used to support the frame 12. As best shown in FIGS. 4 and 6, the support clips 14 can be positioned any location relative to the longitudinal axis of the frame 12 as long as the free end portions 40*a*, 40*b* of the support clip 14 fall between adjacent V-shaped rungs 16.

Figure 7:
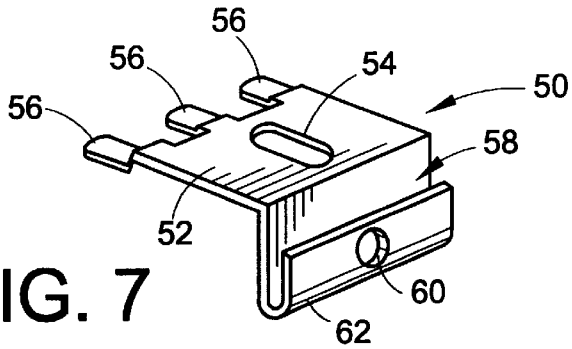
FIG. 7 is a perspective view of a bracket for mounting the upright product merchandiser of the present invention to a conventional gondola-type shelf.

With reference now to FIG. 7, at least one mounting bracket 50 can be used to secure the product merchandiser 10 to a shelving unit. The mounting bracket 50 includes a planar intermediate portion 52 with a slot 54 therethrough; a plurality of tabs 56 extending from a back edge of the intermediate portion 52; and a hook portion 58 extending from a front edge of the intermediate portion 52. An aperture 60 extends through a front wall 62 of the hook portion 58.

Figure 8A:
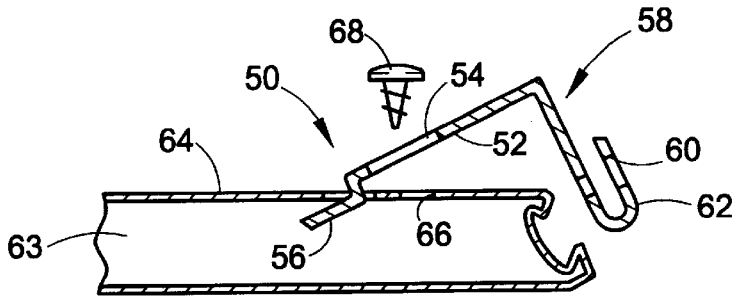
FIG. 8*a* is a partial section view illustrating a first step in securing the mounting bracket of FIG. 7 to a gondola-type shelf.
Figure 8B:
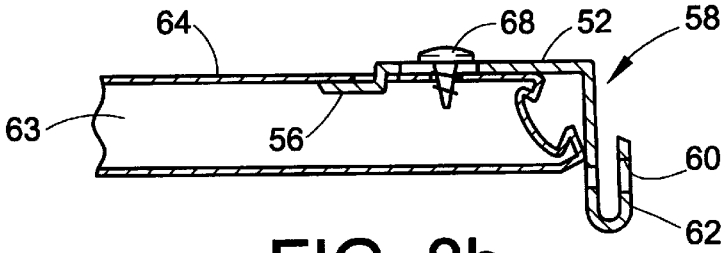
FIG. 8*b* is a partial section view illustrating a second step in securing the mounting bracket of FIG. 7 to the gondola-type shelf.
Figure 9:
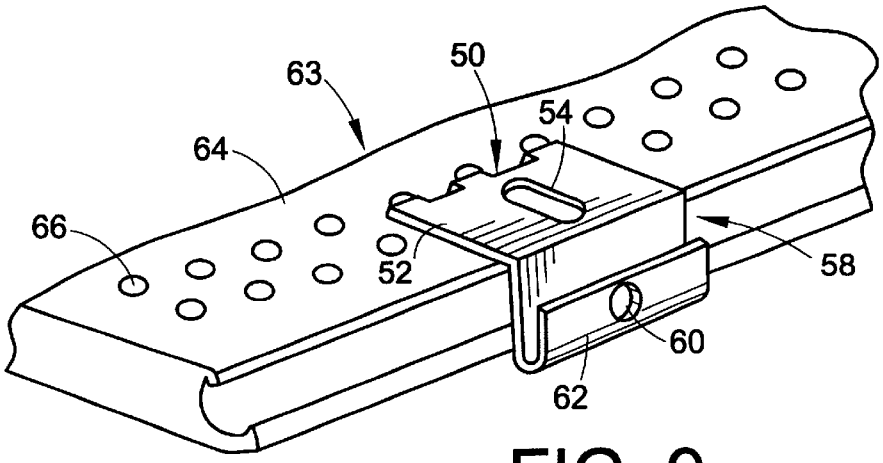
FIG. 9 is a perspective view of a front portion of a conventional gondola-type shelf with the mounting bracket of FIG. 7 secured thereto.

Referring to FIG. 9, the mounting bracket 50 is adapted to secure the product merchandiser 10 to a conventional gondola-type shelf 63 having an upper surface 64 with a plurality of rows of apertures 66 therethrough. With reference to FIG. 8*a*, the tabs 56 are sized and spaced to fit within apertures 66. Thereafter, as shown in FIG. 8*b*, the bracket is pivoted downward until a lower surface of the intermediate portion 52 abuts the upper surface 64 of the shelf 63. The bracket 50 can be fastened to the shelf by the use of a conventional fastener 68 that passes through the bracket slot 54 and through a further aperture 66 of the shelf. The fastener 68 can be of any conventional type, such as discussed in regard to the fastener 38 above. In a mounted position of the bracket 50, the bracket hook portion 58 extends over the front edge of the shelf 63.

Figure 10:
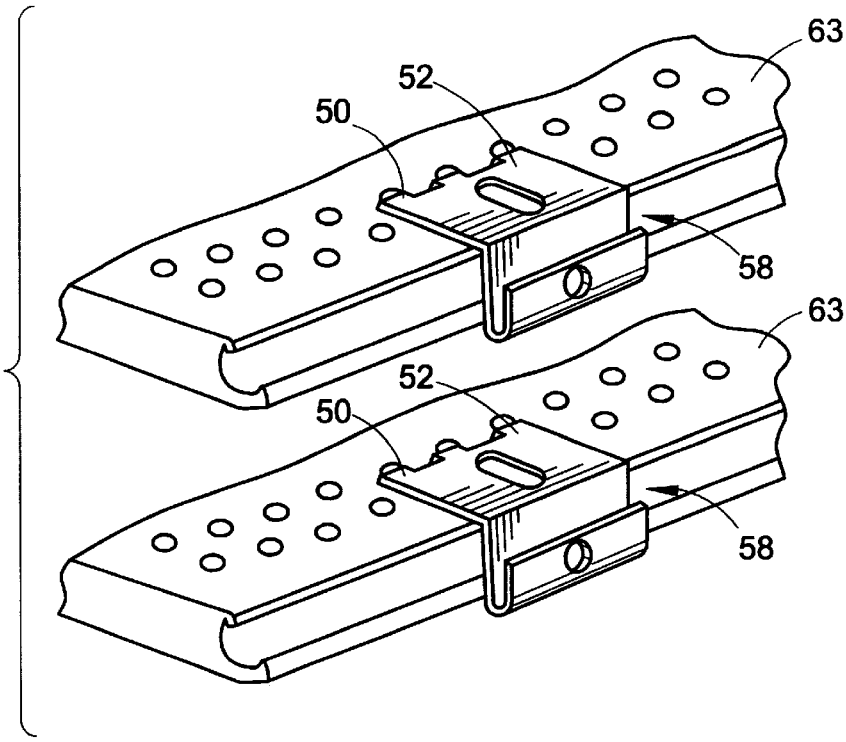
FIG. 10 is a perspective view of the front portions of a plurality of adjacent gondola-type shelves each having a mounting bracket of FIG. 7 secured thereto.

The bracket hook portion 58 is adapted to receive the intermediate portion 34 of the support clip 14. The support clip 14 is secured to the mounting bracket 50 with the fastener 38 (FIG. 2). That is, the fastener 38 passes through the aperture 36 of the support clip intermediate portion 34 and through the aperture 60 of the mounting bracket hook portion 58 to secure the support clip 14 and depending frame 12 to the mounting bracket 50, and thus the shelf 63. With reference to FIG. 10, the product merchandiser 10 of the present invention can be secured to multiple shelves 63 of a shelving unit by using a number of mounting brackets 50 and support clips 14 in the manner described above.

Figure 11:
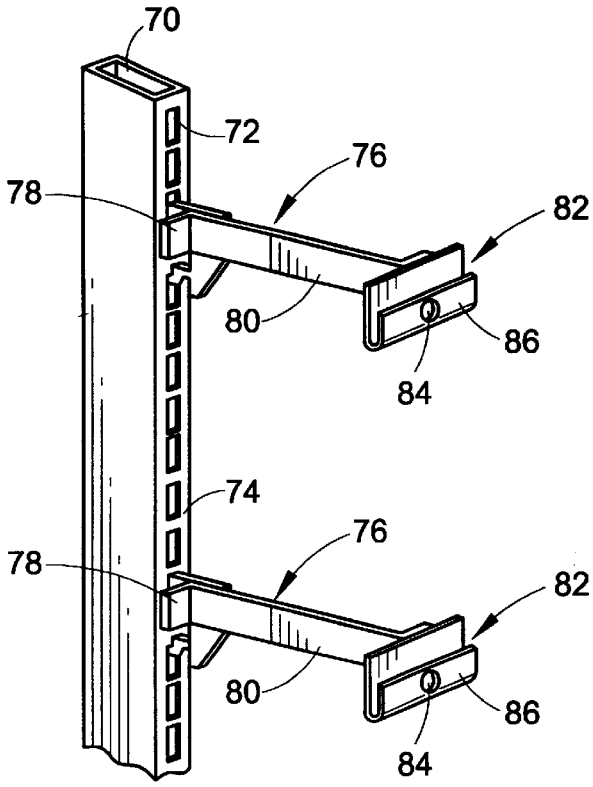
FIG. 11 is a perspective view of a portion of a conventional gondola-type in-line upright and a plurality of second mounting brackets secured to the upright, which mounting brackets support the product merchandiser of the present invention.

Referring now to FIG. 11, the product merchandiser 10 can also be secured to a known in-line upright 70 associated with a gondola-type shelving unit. The in-line upright 70 includes a plurality of slotted apertures 72 through a front wall 74 thereof. A mounting bracket 76 includes a base portion 78 with means such as tabs or hooks that engage with corresponding apertures 72 to support a cantilevered arm 80 that extends from the base 78. A hook portion 82 extends from a free end of the cantilevered arm 80. An aperture 84 extends through a front wall 86 of the hook portion 82.

The bracket hook portion 82 is adapted to receive the intermediate portion 34 of the product merchandiser support clip 14. The support clip 14 is secured to the mounting bracket 76 with a fastener such as fastener 38 (FIG. 2). That is, the fastener 38 passes through the aperture 36 of the support clip intermediate portion 34 and through the aperture 84 of the mounting bracket hook portion 82 to secure the support clip 14 and depending frame 12 to the mounting bracket 76, and thus the upright 70. As illustrated in FIG. 11, multiple mounting brackets 76 can be used to secure the product merchandiser 10 to the upright 70.

Figure 12:
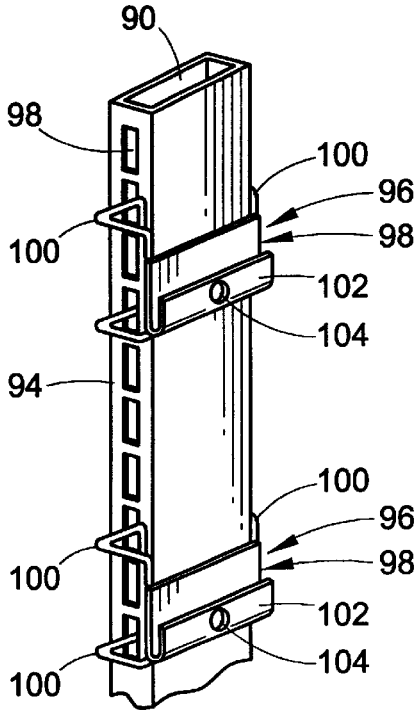
FIG. 12 is a perspective view of a portion of a conventional gondola-type end cap upright and a plurality of third mounting brackets secured to the upright that support the product merchandiser of the present invention.

With reference now to FIG. 12, the product merchandiser 10 can also be secured to a known end-cap upright 90 associated with a gondola-type shelving unit. The in-line upright 90 includes a plurality of slotted apertures 92 through opposing side walls 94 thereof. A mounting bracket 96 includes a central hook portion 98 and bent wire clasps 100 extending from each side edge of the hook portion 98. The clasps 100 are adapted to engage with corresponding slotted apertures 92 to secure the mounting bracket 96 to the end-cap upright 90. The central hook portion 98 includes a front wall 102 with an aperture 104 therethrough.

The bracket hook portion 98 is adapted to receive the intermediate portion 34 of the product merchandiser support clip 14. The support clip 14 is secured to the mounting bracket 96 with a fastener such as fastener 38 (FIG. 2). That is, the fastener 38 passes through the aperture 36 of the support clip intermediate portion 34 and through the aperture 104 of the mounting bracket hook portion 98 to secure the support clip 14 and depending frame 12 to the mounting bracket 96, and thus the upright 90. As illustrated in FIG. 12, multiple mounting brackets 96 can be used to secure the product merchandiser 10 to the upright 90.

Figure 14:
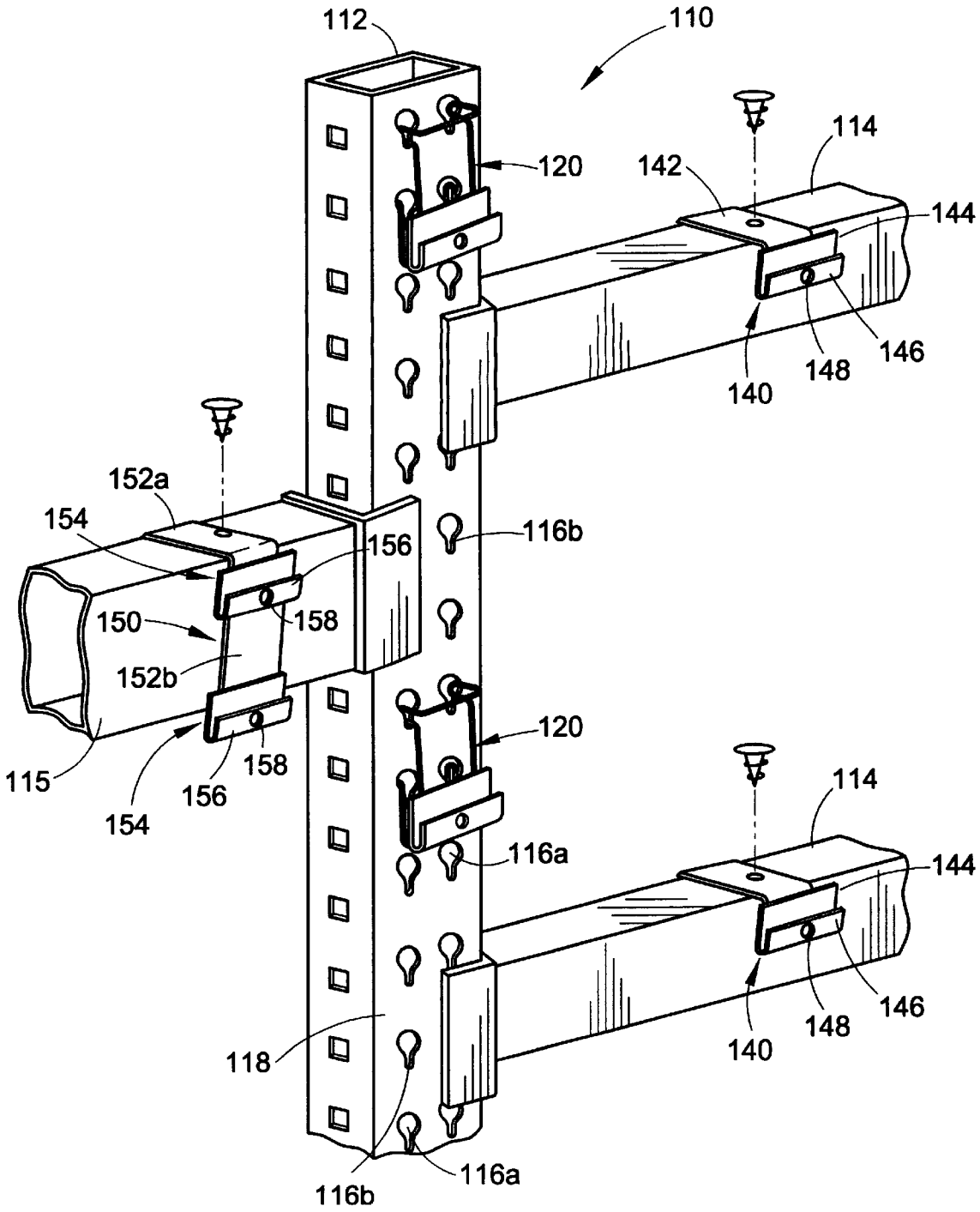
FIG. 14 is a perspective view of a portion of a warehouse-type rack system with i) a plurality of mounting brackets of FIG. 13 secured to an upright thereof, ii) a plurality of fifth brackets for mounting the upright product merchandiser of the present invention to a plurality of lateral beams of the warehouse-type rack system, and iii) a sixth bracket for mounting the upright product merchandiser of the present invention to a single lateral beam of the warehouse-type rack system.

Referring now to FIG. 14, the product merchandiser 10 can also be secured to various support members of a warehouse-type shelving system 110 such as an upright 112, lateral beams 114, and/or lateral beam 115. The warehouse-type upright 112 includes pairs of adjacent key-hole type apertures 116 extending through a front wall 118 thereof. Each key-hole aperture 116 includes an enlarged portion 116*a* and a narrow slot portion 116*b*.

Figure 13:
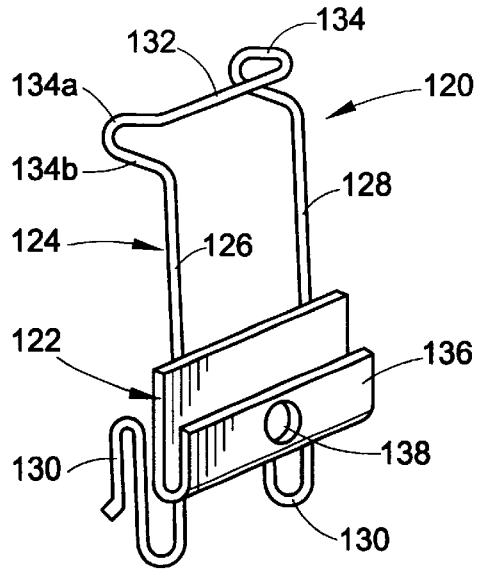
FIG. 13 is a perspective view of a fourth bracket for mounting the upright product merchandiser of the present invention to a warehouse-type rack system.

With reference to FIG. 13, a bracket 120 for mounting the product merchandiser 10 to the warehouse-type upright 112 includes a hook portion 122 that is attached (e.g. spot welded) to a wire clasp 124. The wire clasp 124 is formed or otherwise bent into a generally inverted U-shape with two downwardly projecting rungs 126, 128. The lower free ends of each rung 126, 128 are each bent to form a generally S-shaped hook portion 130 for engaging with a respective key-hole aperture 116. An upper closed portion 132 of the clasp 124 is bent to form two projections 134. Each projection 134 engages with a corresponding key-hole aperture 116. The hook portion 122 includes a front wall 136 with an aperture 138 therethrough.

Figure 15A:
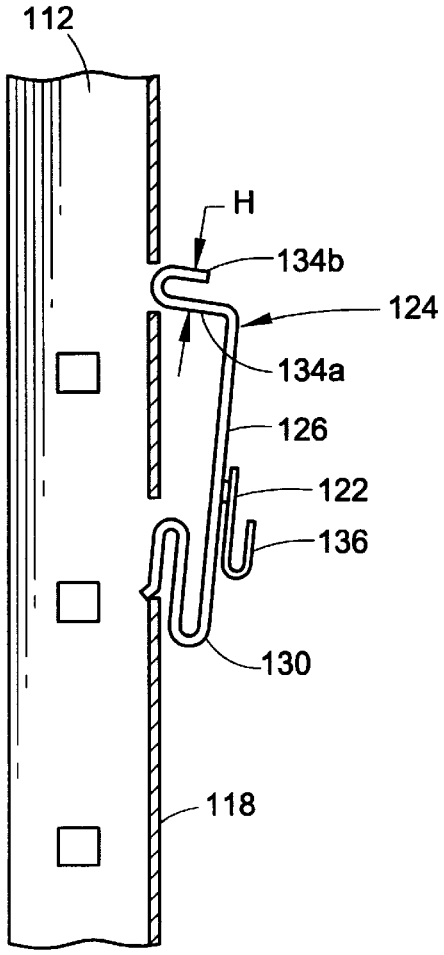
FIG. 15*a* is a partial section view illustrating a first step in securing the mounting bracket of FIG. 13 to the upright of the warehouse-type rack system of FIG. 14.
Figure 15B:
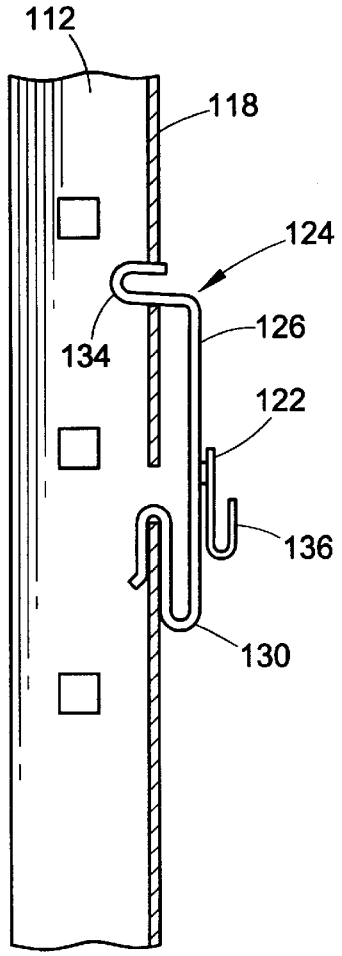
FIG. 15*b* is a partial section view illustrating a second step in securing the mounting bracket of FIG. 15*a* to the upright of the warehouse-type rack system of FIG. 14.

With reference now to FIG. 15*a*, the bracket 120 is mounted to the upright 112 by inserting the downwardly projecting hook portions 130 into the slot portions 116*b* of corresponding key-hole apertures 116. Thereafter, as shown in FIG. 15*b*, the bracket 120 is pivoted to engage the projections 134 into corresponding key-hole apertures 116. More particularly, a lower rung 134*a* of each projection 134 is inserted into a slot portion 116*b* of a corresponding key-hole aperture 116, and the upper rung 134*b* of each projection 134 engages an upper edge of the corresponding key-hole aperture 116. The height H (FIG. 15*a*) of each projection 134 is slightly greater that the size of the key-hole aperture 116 so that the rungs 134*a*, 134*b* of each projection are urged toward each other against a spring force when the projection 134 is inserted into the aperture 116, thereby locking the bracket 120 to the upright 112.

The bracket hook portion 122 is adapted to receive the intermediate portion 34 of the support clip 14. The support clip 14 is secured to the mounting bracket 120 with a fastener such as fastener 38 (FIG. 2). That is, the fastener passes through the aperture 36 of the support clip intermediate portion 34 and through the aperture 138 of the mounting bracket hook portion 122 to secure the support clip 14 and depending frame 12 to the mounting bracket 120, and thus the warehouse upright 112. With reference again to FIG. 14, the product merchandiser 10 of the present invention can be secured to the upright 112 of the shelving unit 110 by using multiple mounting brackets 120 and support clips 14 in the manner described above.

With continued reference to FIG. 14, the product merchandiser 10 can also be secured to multiple lateral beams 114 of the warehouse-type shelving system 110. In this case, a separate mounting bracket 140 is secured to each of the beams 114. The mounting brackets 140 include a planar portion 142 and a hook portion 144 extending from a front edge of the planar portion 142. It is contemplated that the planar portion 142 can include the same or similar tabs 56 and/or slot 54 as the mounting bracket 50 (FIG. 7). As with the mounting bracket 50, the slot can be aligned with a corresponding aperture associated with the beam 114 so as to receive a fastener, such as the fastener 68 associated with the mounting bracket 50 of FIG. 7.

With continued reference to FIG. 14, the hook portion 144 includes a front wall 146 with an aperture 148 therethrough. The bracket hook portion 144 is adapted to receive the intermediate portion 34 of the product merchandiser support clip 14. The support clip 14 is secured to the mounting bracket 96 with a fastener such as fastener 38 (FIG. 2). That is, the fastener 38 passes through the aperture 36 of the support clip intermediate portion 34 and through the aperture 148 of the mounting bracket hook portion 144 to secure the support clip 14 and depending frame 12 to the mounting bracket 140, and thus the beam 114. As illustrated in FIG. 14, multiple mounting brackets 140 secure the product merchandiser 10 to the warehouse-type shelving system 110.

Alternatively, a compound mounting bracket 150 can be used to secure the product merchandiser 10 to a single lateral beam 115 of the warehouse-type shelving system 110. The mounting bracket 150 includes a planar portion 152 that is bent to form at least a first leg portion 152*a* and a second leg portion 152*b* that extends at approximately a right angle to the first leg 152*a*.

The leg portion 152*a* can include the same or similar tabs and/or a slot as the mounting bracket 50 (FIG. 7). As with the mounting bracket 50, the slot can be aligned with a corresponding aperture associated with the beam 115 so as to receive a fastener, such as fastener 68 associated with the mounting bracket 50 of FIG. 7. A plurality of hook portions 154 (e.g. two) are spaced apart and secured to the leg portion 152*b*. Each hook portion 154 includes a front wall 156 with an aperture 158 therethrough.

The bracket hook portions 154 are adapted to receive the intermediate portion 34 of a product merchandiser support clip 14. Each support clip 14 is secured to a respective hook portion 154 with a fastener such as fastener 38 (FIG. 2). That is, the fastener passes through the aperture 36 of the support clip intermediate portion 34 and through the aperture 158 of the respective hook portion 154 to secure the support clip 14 and depending frame 12 to the mounting bracket 150, and thus the beam 115.

Figure 16:
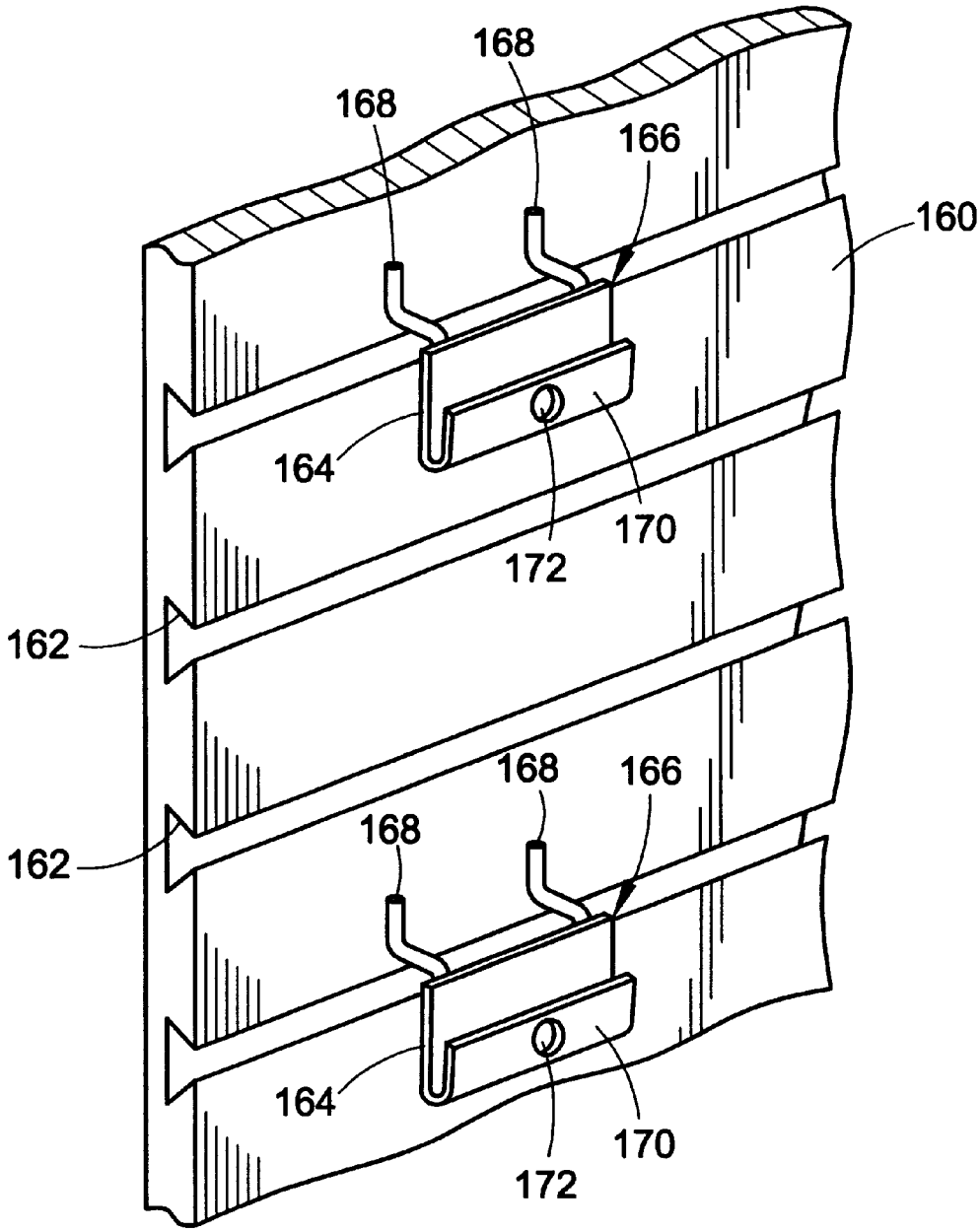
FIG. 16 is a perspective view of a portion of a peg board/slot wall-type merchandising system with a plurality of seventh brackets for securing the upright product merchandiser of the present invention to the peg board/slot wall.

With reference now to FIG. 16, the product merchandiser 10 can also be secured to a conventional peg board/slot wall 160 of a shelving system. The peg board 160 can include a plurality of apertures and/or dove-tail type slots 162. A bracket 164 for mounting the product merchandiser 10 to the peg board 160 includes a hook portion 166 and at least two clasps 168 extending upward from a rear surface of the hook portion 166. Each of the clasps 164 are formed or otherwise bent to form a generally L-shaped rung that extends above the hook portion 166. The upper free ends of the rungs are adapted to engage with the apertures/slots 162 associated with the peg board 160. The hook portion 166 includes a front wall 170 with an aperture 172 therethrough.

The bracket hook portion 166 is adapted to receive the intermediate portion 34 of the product merchandiser support clip 14. The support clip 14 is secured to the mounting bracket 164 with a fastener such as fastener 38 (FIG. 2). That is, the fastener passes through the aperture 36 of the support clip intermediate portion 34 and through the aperture 172 of the mounting bracket hook portion 166 to secure the support clip 14 and depending frame 12 to the mounting bracket 164, and thus the peg board 160. As illustrated in FIG. 16, multiple mounting brackets 164 can be used to secure the product merchandiser 10 to the peg board 160.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof. For instance, it is contemplated that the product merchandiser of the present invention can be formed from materials other that metal rods or wires, such as an injection molded elastomeric or plastic material. Further, any suitable method for joining, securing, or otherwise attaching the V-shaped rungs to the elongate rungs is contemplated.

Having thus described the preferred embodiments, the invention is now claimed to be:

1. A product merchandiser frame comprising:

a first elongate rung;

a second elongate rung spaced from the first elongate rung, the first and second elongate rungs extending generally parallel with a longitudinal axis of the product merchandiser;

a plurality of V-shaped rungs being spaced apart from each other and extending generally normal to the longitudinal axis of the product merchandiser;

each V-shaped rung including a first leg and a second leg that diverge from an apex, the first leg of each V-shaped rung being joined to the first elongate rung and the second leg of each V-shaped rung being joined to the second elongate rung;

the first legs of the plurality of V-shaped rungs cooperating with the first elongate rung to define a first side of the product merchandiser, and the second legs of the plurality of V-shaped rungs cooperating with the second elongate rung to define a second side of the product merchandiser; and the first and second legs of the V-shaped rungs each being adapted to removably support an associated hanger for holding merchandise, and the product merchandiser being adapted to removably enqaqe an associated support clip by resiliently urging the first and second product merchandiser sides toward each other to position the first and second elongate rungs within respective pockets of the associated support clip.

2. The product merchandiser frame of claim 1, further including:

a third elongate rung extending generally parallel with the longitudinal axis of the product merchandiser and joined to each of the first legs of the plurality of V-shaped rungs; and a fourth elongate rung extending generally parallel with the longitudinal axis of the product merchandiser and joined to each of the second legs of the plurality of V-shaped rungs.

3. The product merchandiser frame of claim 1, wherein the elongate rungs and the V-shaped rungs are formed from metal wire.

4. The product merchandiser frame of claim 1, wherein a first V-shaped rung and an adjacent V-shaped rung are spaced far enough apart to permit an associated hanger for holding merchandise to removably clip to the first V-shaped rung while contacting the adjacent V-shaped rung.

5. A product merchandiser comprising:

a frame including a first rung, a second rung spaced from the first rung, the first and second rungs extending generally parallel with a longitudinal axis of the product merchandiser, a plurality of third rungs being spaced apart from each other and each extending generally normal to the longitudinal axis of the product merchandiser, each third rung having a first leg and a second leg, the first leg being joined to the first rung and the second leg being joined to the second rung;

at least one support clip adapted to engage with an associated mounting clip of an associated shelving unit, the at least one support clip including a plurality of pockets, and the product merchandiser being adapted to removably engage with the support clip by resiliently urging the first and second rungs toward each other to position the first and second rungs within the respective support clip pockets.

6. The product merchandiser of claim 5, further including:

a fourth rung extending generally parallel with the longitudinal axis of the product merchandiser and joined to each of the first legs of the third rungs; and a fifth rung extending generally parallel with the longitudinal axis of the product merchandiser and joined to each of the second legs of the third rungs.

7. The product merchandiser of claim 5, wherein the first, second, and third rungs are formed from metal wire.

8. The product merchandiser of claim 5, wherein adjacent third rungs are spaced far enough apart to permit an associated hanger for holding merchandise to removably clip to one of the adjacent third rungs while contacting the other adjacent third rungs.

9. A product merchandiser comprising:

a frame including a first rung, a second rung spaced from the first rung, the first and second rungs extending generally parallel with a longitudinal axis of the product merchandiser, a plurality of third rungs being spaced apart from each other and each extending generally normal to the longitudinal axis of the product merchandiser, each third rung having a first leg and a second leg, the first leg being joined to the first rung and the second leg being joined to the second rung;

at least one support clip adapted to selectively engage the first and second rungs, and engage with an associated mounting clip of an associated shelving unit; and at least one hanger for holding merchandise, the at least one hanger being adapted to removably clip to one of the first and second legs of the third rungs.

10. The product merchandiser of claim 9, wherein adjacent third rungs are spaced far enough apart to permit the hanger for holding merchandise to removably clip to one of the adjacent third rungs while contacting the other adjacent third rungs.

11. The product merchandiser of claim 5, wherein each of the plurality of third rungs are V-shaped, and the first and second legs of the third rungs diverge from an apex.

12. A product merchandiser comprising:

a frame including a first rung, a second rung spaced from the first rung, the first and second rungs extending generally parallel with a longitudinal axis of the product merchandiser, a plurality of third rungs being spaced apart from each other and each extending generally normal to the longitudinal axis of the product merchandiser, each third rung having a first leg and a second leg, the first leg being joined to the first rung and the second leg being joined to the second rung;

at least one support clip adapted to selectively enqaqe the first and second rungs, and engage with an associated mounting clip of an associated shelving unit, wherein the at least one support clip includes an intermediate portion and two free ends, wherein the free ends of the support clip are each shaped to form a pocket between the intermediate portion and the respective free end.

13. The product merchandiser of claim 12, wherein the first and second rungs are located within the respective pockets when the at least one support clip engages the frame.

14. The product merchandiser of claim 12, wherein the intermediate portion includes an aperture for receiving a fastener that secures the at least one support clip to a mounting clip of an associated shelving unit.

15. A product merchandising system secured to an associated support surface for displaying products, the product merchandising system comprising:

a frame including a first rung, a second rung spaced from the first rung, the first and second rungs extending generally parallel with a longitudinal axis of the frame, a plurality of third rungs being spaced apart from each other and each extending generally normal to the longitudinal axis of the frame, each third rung having a first leg and a second leg, the first leg being joined to the first rung and the second leg being joined to the second rung;

at least one support clip selectively engaged with the first and second rungs; and at least one mounting clip for securing the frame to an associated support surface, the at least one support clip being selectively supported by the at least one mounting clip.

16. The product merchandising system of claim 15, further including a plurality of support hangers each engaged to the first and second rungs, and each engaged to a corresponding one of a plurality of mounting clips.

17. The product merchandising system of claim 16, wherein adjacent third rungs are spaced far enough apart to permit one of the plurality of support hangers to removably clip to one of the adjacent third rungs while contacting the other of the adjacent third rungs.

18. The product merchandising system of claim 15, wherein:

the at least one support clip includes an intermediate portion and two free ends, wherein each of the free ends of the support clip form a pocket between the intermediate portion and the respective free end; and the mounting clip including means for attachment to the shelving unit, and a hook portion adapted to receive the intermediate portion of the at least one support clip.

19. The product merchandising system of claim 15, further including at least one first fastener for selectively securing the at least one support clip to the at least one mounting clip.

20. The product merchandising system of claim 19, further including at least one second fastener for selectively securing the at least one mounting clip to an associated support surface.

* * * * *